US006571533B2

(12) United States Patent
Mahood et al.

(10) Patent No.: US 6,571,533 B2
(45) Date of Patent: Jun. 3, 2003

(54) BOTTLE HANDLING DEVICE

(75) Inventors: Bradley John Mahood, London (CA); Edward Stanley James Miziolek, London (GB); Robert G. Dickie, Newmarket (CA); Bernard Beasley, London (CA)

(73) Assignee: Labatt Brewing Company Limited, London (CA)

( * ) Notice: Subject to any disclaimer, the term of this patent is extended or adjusted under 35 U.S.C. 154(b) by 0 days.

(21) Appl. No.: 09/942,692

(22) Filed: Aug. 31, 2001

(65) Prior Publication Data

US 2003/0041559 A1 Mar. 6, 2003

(51) Int. Cl.[7] ..... B65B 5/00

(52) U.S. Cl. ..... 53/263; 53/257; 206/196; 206/201; 206/814; 220/528; 220/510; 220/509

(58) Field of Search ..... 53/263, 257, 262; 220/528, 510, 509, 515, 516, 518; 229/15, 45; 206/196, 201, 814

(56) References Cited

U.S. PATENT DOCUMENTS

| | | | | | |
|---|---|---|---|---|---|
| 3,343,742 | A | * | 9/1967 | Siegler | 229/120.36 |
| 3,752,385 | A | * | 8/1973 | Woodgate | 220/510 |
| 3,767,106 | A | * | 10/1973 | Morgan | 217/22 |
| 3,948,435 | A | * | 4/1976 | Palmer | 229/120.36 |
| 4,094,484 | A | * | 6/1978 | Snyder | 229/120.02 |
| 4,256,224 | A | * | 3/1981 | Hirota | 206/203 |
| 4,326,629 | A | * | 4/1982 | Tate | 206/203 |
| 4,591,090 | A | * | 5/1986 | Collins et al. | 217/32 |
| 4,793,548 | A | * | 12/1988 | Ross | 217/31 |
| 5,058,802 | A | * | 10/1991 | Rutledge | 229/120.24 |
| D333,093 | S | * | 2/1993 | Rehrig et al. | D3/314 |
| 5,769,230 | A | * | 6/1998 | Koefelda | 206/508 |
| 6,336,556 | B1 | * | 1/2002 | Gale | 206/193 |

FOREIGN PATENT DOCUMENTS

| | | | | |
|---|---|---|---|---|
| EP | 000413245 A1 | * | 2/1991 | B65D/1/38 |
| GB | 2220193 A | * | 1/1990 | B65D/6/00 |
| WO | WO 91/07327 | * | 5/1991 | B65D/25/06 |

* cited by examiner

*Primary Examiner*—Stephen F. Gerrity
*Assistant Examiner*—Louis Tran

(57) ABSTRACT

A bottle handling device for assisting in inserting a number of similar sized bottles into a secondary container, such as a partitionless beer carton. The device comprises a frame which, when inserted into the empty carton, provides a number of similar sized cells or compartments equal to the number of bottles which would completely fill the carton. The frame is maintained by support means above the shoulders of the bottles when located in the carton. Each bottle is inserted into, and its main body passes through, the frame until the bottle sits on the carton floor, the walls of each cell preventing a bottle in that cell from toppling over and hindering the insertion of further bottles and completion of filling of the carton. Upon completion and filling of the carton, the device is readily removed for reuse and the bottles are maintained in their upright condition by contacting adjacent bottles and the carton walls.

20 Claims, 12 Drawing Sheets

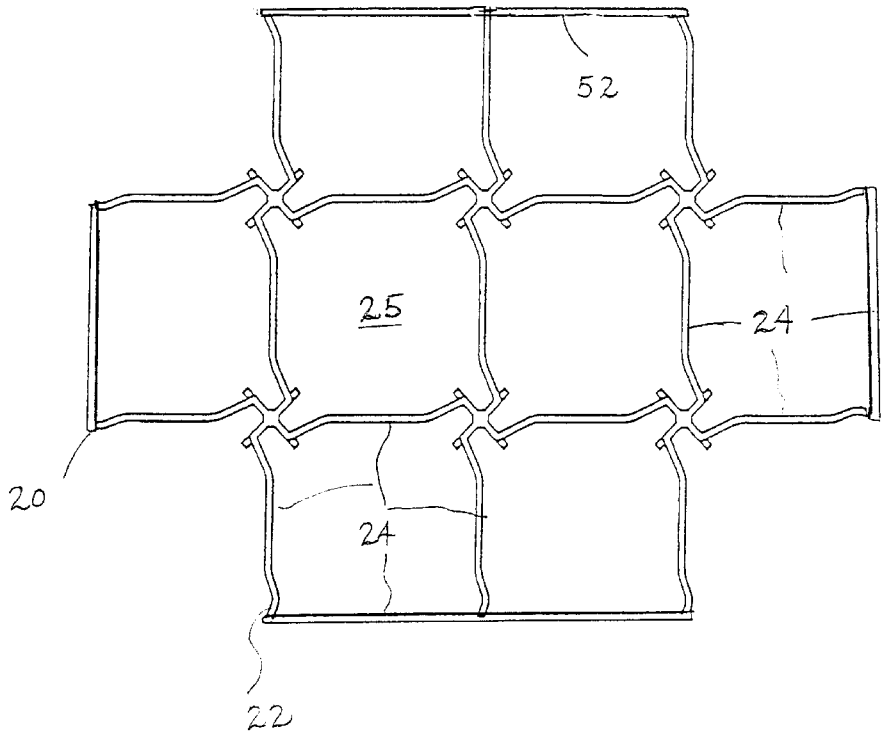
FIG. 3b
FIG 3c
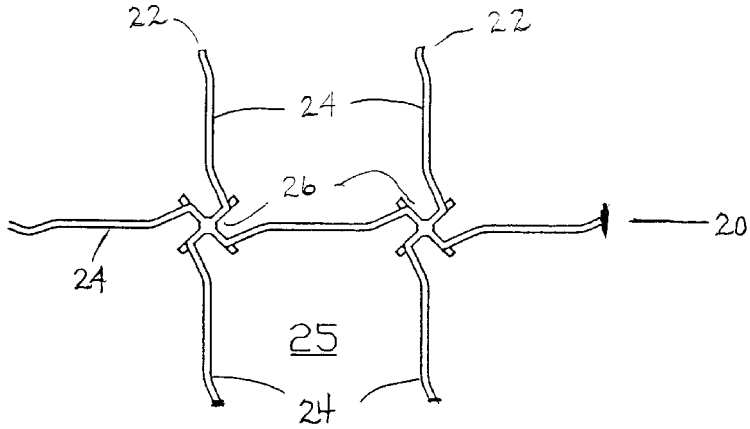

BOTTLE HANDLING DEVICE

FIELD OF THE INVENTION

The present invention relates to secondary packaging of the type often used for transporting a plurality of primary packages especially glass bottles in, for example, the distribution of brewery or other beverage products to the public. More specifically, this invention relates to a bottle handling device for use in association with such secondary packaging and particularly, its use in a system for returning such bottles when empty to a recycling facility or the like using the original secondary container.

BACKGROUND OF THE INVENTION

Secondary packaging is often employed in retail packaging and distribution of foods especially beverages such as soft drinks or brewery products. Typically such packaging is made of corrugated board or fiberboard, and, in its most familiar form, as generally rectangular cartons. As will be noted, the present invention will be described in detail with reference to the brewing industry and the secondary containers will be generally referred to as "cartons". Such cartons are usually provided with partitions or "dividers" which divide the carton's interior into a plurality of pocket-like compartments or cells that are adapted to receive individual ones of the primary packages say bottles. This partitioning of the cartons interior serves a number of purposes not the least of which is to hold the bottles in mutually spaced relation. This is intended to help avoid the breakage that direct contact due to movement of the bottles might otherwise occur during the course of normal handling of the carton.

The dividers are usually made up of a series of interconnected wall members. Depending on any one or more of a myriad of design factors, such members may be formed as part of, or affixed to, the interior walls of the carton. More typically, however, (and especially in the case of dividers intended for use with ten or more bottles), such dividers are manufactured independently of the carton proper. They are only subsequently inserted into the carton most often immediately prior to the introduction of the bottles and are not secured to the container. The set-up and insertion steps are often mechanized operations effected by specialized sections of high speed packaging lines.

All dividers, to be practical and commercially suitable for such applications, must be inexpensive both in terms of their materials and their assembly/insertion costs, and yet must survive not only the initial packaging operation, but also be convenient and durable enough to facilitate refilling the carton by the consumer for the return of recyclable bottles. In that regard, with respect to the latter activity, the divider functions adequately provided care is taken by the consumer in inserting the empty bottles back into the case. Not surprisingly, in view of the above comments, attempts have been made to make the system more convenient whilst maintaining low costs, particularly in relation to the packaging of bottled brewery products.

Traditionally the brewing industry standard for dividers in the so-called "twenty-four pack" carton or cases, (named to reflect the number of bottles each such case is adapted to carry), comprises a series of eight strips or panels of relatively thin and easily deformed fiberboard. Three such panels are arranged in a spaced, mutually parallel orientation and these are traversed at right angles by the remaining five strips which are themselves arranged in a mutually parallel evenly spaced apart relation. Typically the junction between any two strips is formed by the inter-nesting of opposed, complimentary slots, arranged on respective ones of the two intersecting strips. The result is the creation of a rectangular array of twenty-four generally rectangular similar sized pockets the outer ones of which use part of a container wall to "complete" the cell. Such dividers are usually produced and assembled by the carton manufacturer and shipped in a collapsed condition to the brewery packaging department. In the brewery facility the collapsed dividers are drawn from inventory on a demand basis shortly before cartons into which they are to be placed are scheduled for filling. Machinery at the packaging facility sets up both the required number of cartons and corresponding dividers and inserts an erected divider within each carton. Packing equipment then aligns the cartons and dividers in a predetermined orientation, and droploads the twenty-four product—filled bottles into their assigned pockets within the carton. Such dividers are expensive to manufacture and handle and any malfunction of the set-up equipment can be very disruptive and costly. Even if intended to be re-used, the damage rate during the use cycle is extremely high and many, upon their return, cannot be re-used. Yet, in spite of these shortcomings, they have for many years been, and up to now remain, the commercial solution of choice in many markets.

With respect to the re-use of the carton to return empty bottles, this can work adequately provided care is taken in inserting the empty bottles into the bottle pockets. The divider wall material is relatively easily crushed and if a bottle is not cleanly inserted into the pocket, the pocket wall material can readily be deformed or even flattened. This not only prevents the specific bottle from being successfully lodged correctly in its associated pocket, but the integrity of adjacent and other pockets are compromised and will then also probably not accept empty bottles as well. Therefore attempts to pack the bottles often results in the need to re-pack. This has proved to be not only an inconvenience to the individual home consumer but to a retail seller of the product, such as a bar or restaurant, where the need to load empty bottles into cartons and remove them from the beverage dispensing area in a rapid and convenient manner is very important since otherwise it creates disruptions in work flow and reduced efficiency.

In view of the above and to further reduce costs, attempts have been made to market the consumer products in primary containers, with bottles being a significant example, in secondary containers, usually cartons, with no partitions separating the bottles. It will be appreciated that when dividers are used, the carton interior length and width dimensions are designed to allow for the thickness of several strips of the divider material. Consequently, when the divider unit is omitted, there would be space between adjacent bottles allowing same to move and make direct contact with each other during normal handling providing potential for increased scuffing and breakage of bottles. To reduce and even eliminate that possibility, when the divider unit is omitted the interior length and width dimensions of the carton are reduced so that the bottles are maintained in direct and constant contact with adjacent bottles and/or carton walls which prevents the bottles moving. Obviously only the main cylindrical part of the bottle that is, from the shoulder to the bottom (herein termed "main body"), can contact each other and, in fact, modern designs include features such as panel bulbs which restrict contact between adjacent bottles to specific bottle areas where adverse effects can be minimized. It should also be noted that when a partitionless carton is fitted with standard round bottles, the volume in the carton containing the main bodies of the bottles will be fully occupied apart from a series of voids or spaces formed between adjacent bottles and between some of the bottles and adjacent carton wall(s) because of the circular character of the bottles. The main body will, in general have the largest diameter of all sections of the bottle. Machine-filling partitionless cartons with full bottles at the bottling facility does not create these problems. However, the omission of the dividers does not eliminate problems when hand packing of the carton with empty bottles for their return has to be effected. In fact, in the absence of the divider unit there is scope for the empty bottles to topple over when being placed in the carton especially in busy on-premise locations and the problems referred to above are encountered.

Consequently there remains a need in the beverage and similar industries, especially as it applies to the re-use of secondary cartons to return empty bottles, for a lasting, cost-effective and a more user-friendly delivery system.

SUMMARY OF THE INVENTION

In accordance with a broad aspect of the present invention, there is provided a handling device for primary containers such as beverage bottles and specifically, a device to assist in manually filling partitionless secondary containers such as beer cartons with empty bottles. The invention provides a device comprising a frame, which defines a number of cells or pockets, the same number as the number of primary containers required to fill the carton. The cells are adapted to allow the main body of the primary container when the primary container in its usual upright orientation i.e. with its longitudinal axis generally at right angles to the plane of the frame, to enter and pass through. The device of the present invention is adapted to be inserted and be maintained in a secondary container so that the frame which defines the bottle cell array is maintained above the base of carton at a height which allows a full complement of bottles to be inserted into and sit on the base of the carton. It will be appreciated that the main bodies of those bottles will effectively be in contact leaving no space where they are in contact. Consequently, as taught by the present invention, the frame member which defines the cells is maintained above the volume to be occupied by the main bodies of the enclosed bottles. The frame may be maintained in that position in a number of ways. For example, it may be adapted by being dimensioned so that the extremities of the longitudinal and/or transverse frame members, which make up the frame frictionally engage the inner surfaces of the respective end and/or sidewalks of the secondary container. In one embodiment, appropriate chamfering of those extremities enables the frame to be wedged into the carton and thereby be frictionally maintained as desired. However, it is preferred that separate frame support means are provided which extend from the frame so as to contact the interior of the base of the carton or to engage the upper edge of a carton side and/or endwall. These enables the frame to be more easily and conveniently positioned at the desired height from the carton base and to be easily inserted and removed from the carton.

Whichever method of support for the frame is used, the length of the bottle guides is chosen to ensure the bottles during insertion and thereafter do not become angled or slip sideways in the cell thereby preventing subsequently inserted bottles from being cleanly inserted into vacant especially adjacent cells.

In an alternative embodiment, the support means comprise arms which extend from a part of the frame which, when the device is within a secondary container, preferably abuts a wall of said container, said arms extending from an opposite side of said frame to that which carries said bottle guide members to an upper edge of the end or the sidewall of said secondary container and is adapted to engage same and maintain said frame in position above the volume occupied by said bottle main bodies.

It may be noted that the main body of the primary container is dimensioned such that it cannot pass through the cell to sit on the container base unless the primary container is generally upright i.e. approximately at right angles to the plane of the frame. It is a feature of the device of the present invention that the cell and bottle guide combination can accept primary containers which are not initially fully in the required orientation and then corrects the orientation thereby ensuring that they pass through the cell and rest in the required upright position in the container whilst eliminating any tendency to fall over or otherwise hinder the insertion of further bottles into other cells.

For example, in the case of a partitionless six-pack, there might only be one longitudinal frame member and two transverse members connected together to form six equal sized cells i.e. there might only be one frame member in a series. However, it is preferred that there are three parallel longitudinal members, a long one extending the length of the carton and two short members, one on each side of the longer member and each connecting two adjacent extremities of the transverse members.

It is preferred that at least two but especially the four corner cells are bordered on only two sides by the sections of the longitudinal and transversal frame members. In this embodiment, the remaining two walls of the corner cells are provided by parts of the container end and sidewalks where they meet at a corner of the rectangular cell array. In response to the end and sidewalks being pushed outwardly in response to the insertion of the device of the invention into the container, the board material forming the corner can be deformed somewhat to form an obtuse angle i.e. the corner will become rounded to some extent effectively increasing the cell diameter. It will be appreciated that any internal volume lost because of the corner deformation in this manner is inconsequential since it was, in effect, "dead" space since it was not as occupied by any bottle enclosed in the container.

The connections between the frame longitudinal and transverse members preferably take the form of a cross—"X"—whose limbs are not aligned with the longitudinal axis, which includes their associated sections. In addition, such sections are preferably secured to one of the limbs of the X shaped connection proximate to i.e., just shy of, the end thereof.

The connections are adapted to twist about a vertical axis in response to a movement of an associated section away from the connection. This part-rotation, in effect, lengthens the cell wall allowing it to bow and allow a bottle, which causes the said movement, to pass through the cell. In addition, each section preferably has a sinusoidal shape along its length for example in the form of a stylized letter "S". This also provides flexibility and capability to deform thereby straightening its "S" shape and, in effect, becoming longer in response to pressure being applied against it by a bottle inserted into the cell bounded by that section.

The device of the present invention is intended to be re-used and hence should be relatively strong whilst providing a certain flexibility to the frame cell walls. The required characteristics can be met by a variety of materials and in particular, a number of plastic materials such as various polyolefins such as a polyethylene and especially polypropylenes.

It is preferred that the device be manufactured by molding such as injection molding and, especially, in one piece. However, there are advantages to manufacturing the device in several parts and assembling these various components to form the device as required. For example, the frame support members and/or the bottle guides can be produced independently of the frame. Each such member can be provided with threaded end portions and the connections in the frame may each be provided with an internal screw thread adapted to receive the threaded portion of an associated support or bottle guide member. In an alternative embodiment, each support and guide member can be secured to the frame via one of the well-known snap-fit arrangements for example, forming the end or the support and/or guide member as a bayonet fitting. An advantage of manufacturing the several components separately is that it avoids the use of relatively large molds which is expensive to produce and replace. Furthermore, transport and storage costs of the device as a number of components is also reduced.

In a preferred embodiment, the support means extend from the frame downwardly to sit on the interior surface of the base of an associated container. It is preferable that the support members are simply extensions of some of the bottle guides, the latter not required to be of that length to fulfill their bottle guide function as described herein.

In one embodiment, therefore the present invention provides a bottle handling device for inserting a predetermined number of similar bottles in an upright orientation into a rectangular container having a bottom, two side and two end walls and which container is adapted to be fully filled by said number of bottle when in that orientation, the device comprising a generally rectangular frame adapted to be removably inserted into and nestle in said container which frame is constructed of a series of spaced mutually generally parallel longitudinal wall members and a series of spaced mutually generally parallel transverse wall members both series of members having ends which extend substantially to a container end wall or a container sidewall respectively when the device is located in said container, each member of each series being joined at a series of connections with members of the other series to form a plurality of similar sized cells each of which is bound on at least two sides by sections of said longitudinal and said transverse members each cell being adapted to allow passage therethrough of a main body of a bottle, said frame being adapted, when located in a container, to be maintained parallel to a base of said container and in a volume in said container above a lower volume occupied by main bodies of bottles when located in said container, a bottle guide member extending at right angles from each connection which is shared by four cells and which is adapted to extend toward said container base, each said bottle guide member being dimensioned to fit within a void existing between four bottles when located in said cells.

In a further embodiment, the invention provides a bottle handling device for inserting twenty-four similar bottles in an upright orientation into a container having a rectangular shaped bottom, two side and two end walls and which container is adapted to be fully filled by said number of bottle when in that orientation, the device comprising a frame which is constructed of a series of spaced mutually generally parallel longitudinal wall members and a series of spaced mutually generally parallel transverse wall members both series of members having ends which extend substantially to a container end wall or a container sidewall respectively when the device is located in said container, each member of each series being joined at a series of connections with members of the other series to form a plurality of similar sized generally rectangular cells arranged in a rectangular array each cell of which is bound on at least two sides by sections of said longitudinal and said transverse members each cell being adapted to allow passage therethrough of a main body of a bottle, said frame being adapted to be removably insertable into and nestle in said container, and when located in a container, to be maintained, via support means extending out of a plane which includes said frame, parallel to a base of said container and in a volume in said container above a lower volume occupied by main bodies of bottles when bottles are located in said container, a bottle guide member extending at right angles from each connection which is shared by four cells and which guide member is adapted to extend toward said container base and is dimensioned to fit within a void existing between four adjacent bottles when same are located in said cells.

DETAILED DESCRIPTION OF A PREFERRED EMBODIMENT

Introduction to the Drawings

Over the course of the detailed description of a preferred embodiment of the present invention that follows below, reference will be made to the accompanying drawings, in which:

FIG. 1 is a perspective view of a bottle handling device of the present invention for use in association with a beer carton adapted to contain twenty-four bottles, FIG. 2 is a perspective view of another embodiment of the bottle handling device of the present invention, FIGS. 3*a–c* are plan views of three further embodiments of bottle handling device of the present invention:

FIG. 3*a*—for use in association with a 24 bottle carton;

FIG. 3*b*—for use in association with a 12 bottle carton; and

FIG. 3*c*—for use in association with a 6 bottle carton

In the following the terms "upwardly" and "downwardly" refer to the device in its normal orientation, as it is located in a container, with the frame in a generally horizontal position.

Further, similar parts of the device are identified by the same reference number in all of the drawings.

Figure 1:
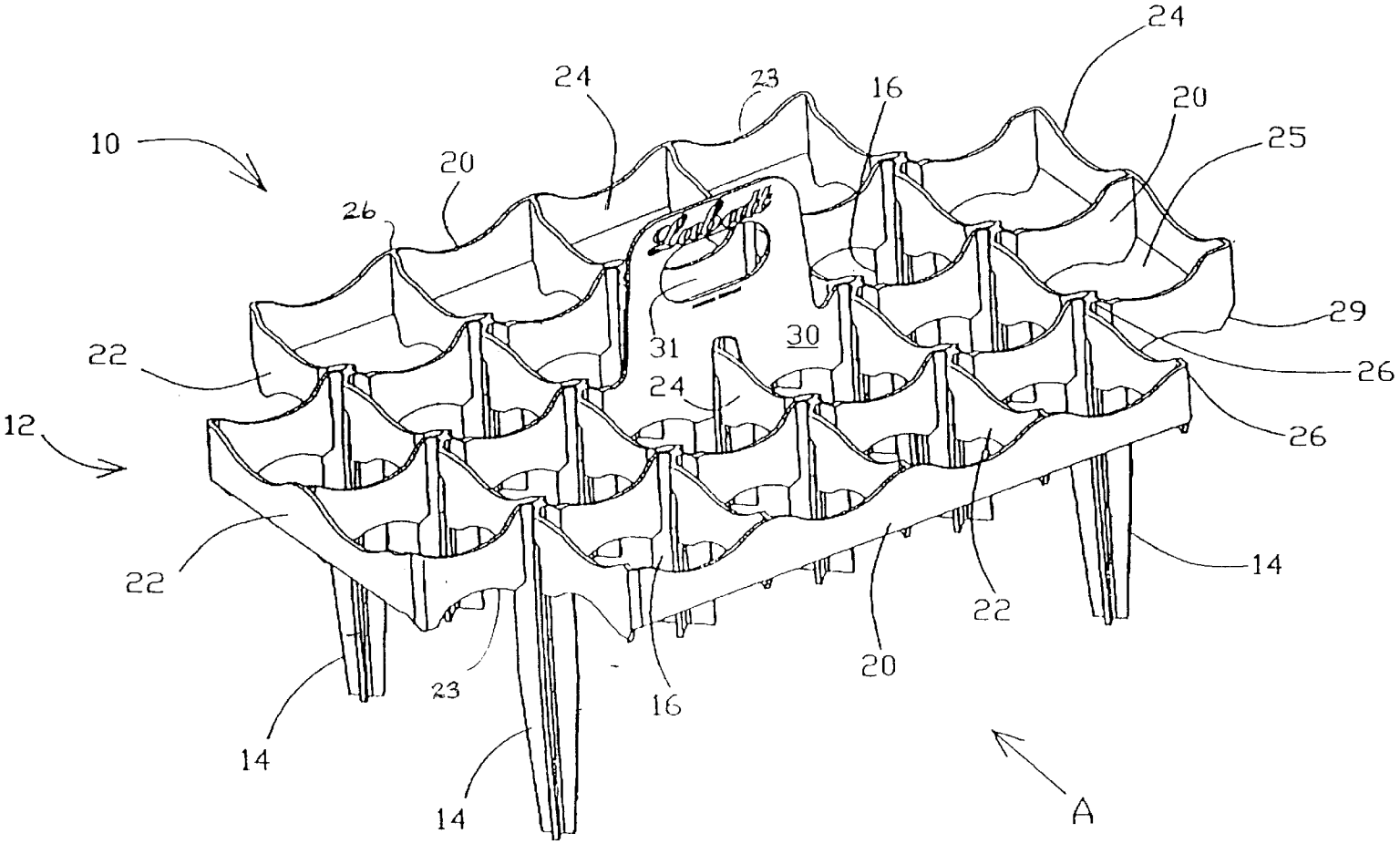

In the drawings, and in particular FIG. 1 there is illustrated a preferred bottle handling device of the present invention, generally designated 10, for use in association with a twenty-four so-called "pint" (341 ml) bottle beer carton or pack. The device comprises a frame generally designated 12 and extending therefore four frame supports 14 and eleven bottle guides 16. In this embodiment, the four supports 14 are effectively, extended bottle guides and fulfil both functions. The frame 12 consists of a series of five longitudinal wall members 20 and a series of seven transverse wall members 22. These two series of generally parallel wall members are oriented at right angles to each other and each member of each series of wall members is connected to members of the opposite series of wall members at joints or connections such as 26 thereby forming a rectangular array of twenty-four similar sized rectangular cells. Note that the full rectangular configuration is not totally enclosed by frame wall members in this embodiment. Each of wall members 20 and 22 is made up of a number of similar sized wall sections 24 each connected through a connection 26 to the adjacent section 24 and the longitudinal and transverse members are joined to each other through the same connections 26 and 26". It will be noted that some of the connections 26 connect 2, 3 or 4 wall sections. The combination of a section 24 and part of its associated connection 26 constitute a cell wall. Each cell 25 has four such walls except for each of the corner cells which have only two such walls, part of the carton end-and side-walls making up the other two walls of those corner cells. Each of the twenty-four similar sized cells 25 is adapted to receive a bottle. It will be appreciated that the reduced internal dimensions of a partitionless carton means that each cell has a diameter less than that of a bottle main body because of the thickness of the frame wall members. This can readily been seen by referring to FIG. 9 which shows that, with adjacent bottles contacting each other, there is no space available to accommodate wall sections 24. However, as will be described later, the cells are adapted to allow the entry and passage therethrough of a bottle main body. The connections 26 and indeed the whole length of the frame supports 14 and bottle guides 16, have a cross section in the form of a cross —"X"—with a rod-like axial portion at the intersection of the arms 28 of the X—shown clearly in FIG. 3. Each connection 26 is adapted to twist about the axial portion. It will be noted that each section 24 joins its associated connection 26 just short of the end 30 of each of the arms of the X shape leaving the ends 30 protruding into an associated cell 25. Each section 24 is shaped: (a) longitudinally in the form of a distorted letter "S" and (b) laterally, the upper edges 23 and, except in the case of the outermost frame members 20 and 22, lower edges 27, being scalloped imports flexibility to the section 24. More importantly, the scalloped upper edge assists in directing the bottles into the cells when the bottles are not presented to the cells in a fully upright orientation. Moreover the Section 24 in combination with connection arms 26 impart resiliency to the cell wall—again allowing the cell diameter to be temporarily increased in response to a bottle main body being inserted into pass through the cell with the bottle coming to rest on the base of the carton. The cell wall 24 then returns to its original position. It will be appreciated that usually only one bottle at a time is inserted in the carton and therefore adjacent cells will not usually be required to expand to accommodate bottle entry at the same time. In any event, the flexibility of the whole system, which includes the carton walls ensures that insertion of bottles up to the full complement is readily accomplished. Extending downwardly, one from each connection 26, which join four wall sections 24, are bottle guides 16. In the embodiment shown, four of the guides are further extended and these constitute legs or support members 14 whilst still functioning as bottle guides. When the device is in use in a carton—refer FIG. 8 or a for example—the ends of these legs 14 contact and sit on the interior of the base of the container and maintain the frame horizontally and as a set height from the base and all supports 14 and all bottle guides 16 are located in the vertical voids which are formed between four adjacent bottles located in the carton. The three center longitudinal members 20 are connected at each of their ends, by associated outer most transverse members 22 and the adjacent ends of the center five transverse members 22 are connected by associated outermost longitudinal members 20. The four corner cells are defined by two wall sections 24, one from a longitudinal frame member 20 and one from a transverse frame member 22 in combination with a part of a carton sidewall and a part of a carton endwall. It is not unusual for cartons when set up, i.e. erected, not to be perfectly square at the corners resulted in a corner cell being deformed. This can cause problems when attempting to refill the carton with empty bottles for return to a collection depot. The device of the present invention reduces or even eliminates this problem. When inserted into a carton, it is rigid enough to deform the carton sufficiently to accept the rectangular frame. Moreover, in this preferred embodiment where the corner cells are formed in part by parts of the carton end and sidewalls, the cell mouth through which the bottle main body must pass is slightly larger because of the absence of the two frame portions. This is especially advantageous in the "flaps-in" carton condition when the flaps take up some interior volume. More importantly, as the frame squeezes its way into the carton, it can apply pressure to the side and/or end walls of the carton forcing those walls to bulge outwardly slightly. They are able to do that without adversely impacting the integrity of the carton since, simultaneously with the walls' movement, the corners of the carton can move inwardly i.e. become "rounded" to some extent. This provides some "extra" material to allow for expansion of the cell mouth sufficiently for bottle entry. It should be noted that any interior volume taken up or lost by this corner deformation does not adversely affect the entry of round bottles into the corner cell since that volume is usually unoccupied i.e. it is usually dead space. It will also be noted that the lower corners 29 of the frame walls defining the outermost cells are chamfered, in this embodiment at an angle of about 30°. This assists when inserting the device into a carton since exact correspondence with the carton opening is not required—the device self-centres. Moreover, the insertion of the device can deform the carton slightly if required, as described above.

Figure 2:
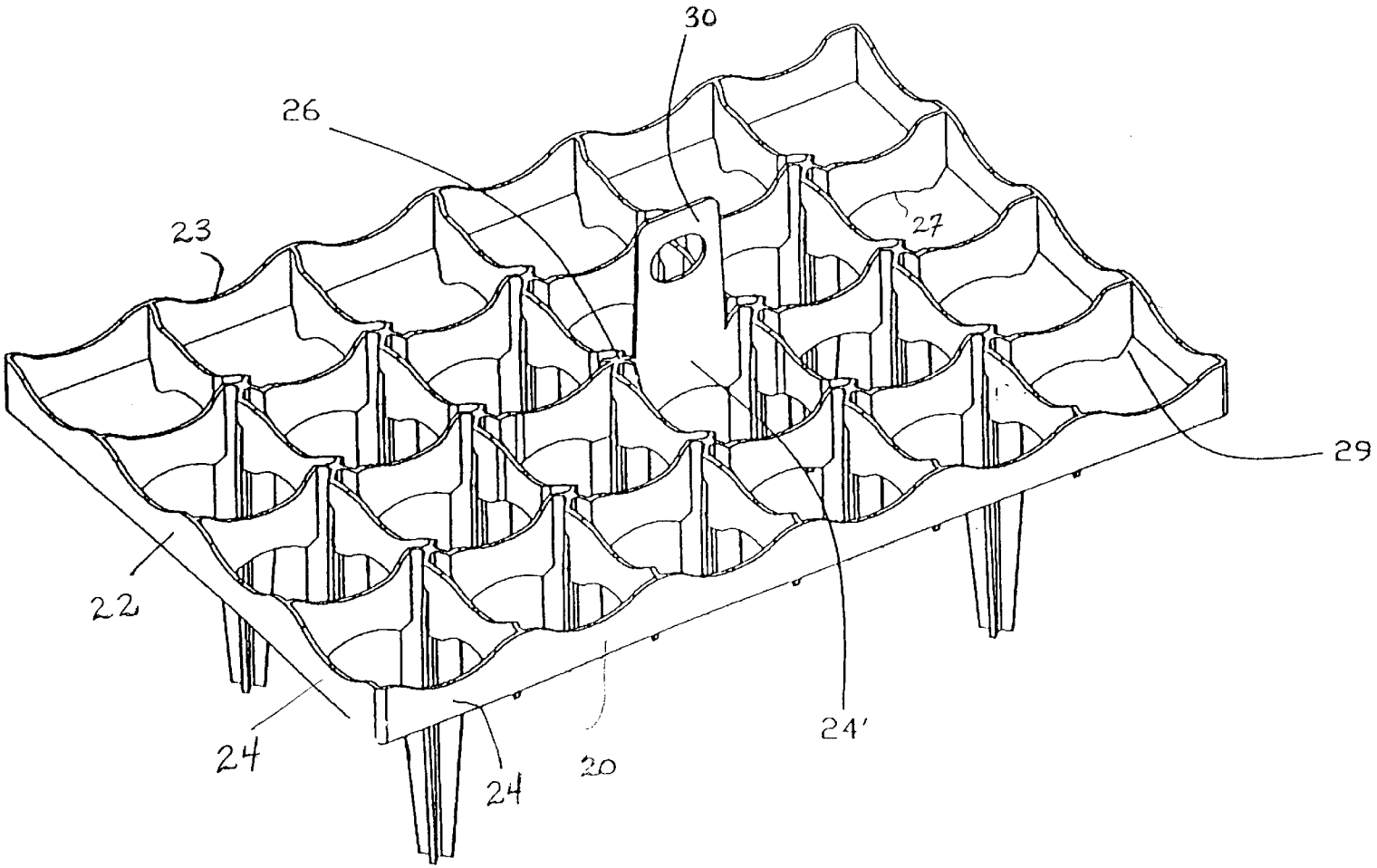

In this embodiment upstanding from the center longitudinal frame member is a handle 30, which, for convenience of use contains, an oval hand-hole 31. This handle 30 may be of any convenient height, for example, small enough to lie inside a sealed carton for transport, refer to FIG. 8, or the handle may be arranged to extend above the top wall of the carton. In this case, when the carton has been filled with empty bottles and is being resealed for return the handle is visible i.e. evidently still in the carton and this provides a reminder that it is to be removed for reuse. FIG. 2 shows a modified version of the device of FIG. 1 in which the four corner cells are defined by four frame wall sections 24. Further, the handle member 30 extends from one wall section 24 and has a width less than the length of a cell wall 24. As a result, it is able to pass through a cell and allow for stacking of similar devices. This feature is important to facilitate transport or storage of numbers of the devices. Other features of this embodiment of the inventive device are as described for similar features in the embodiment shown in FIG. 1 and associated drawings.

Figure 5:
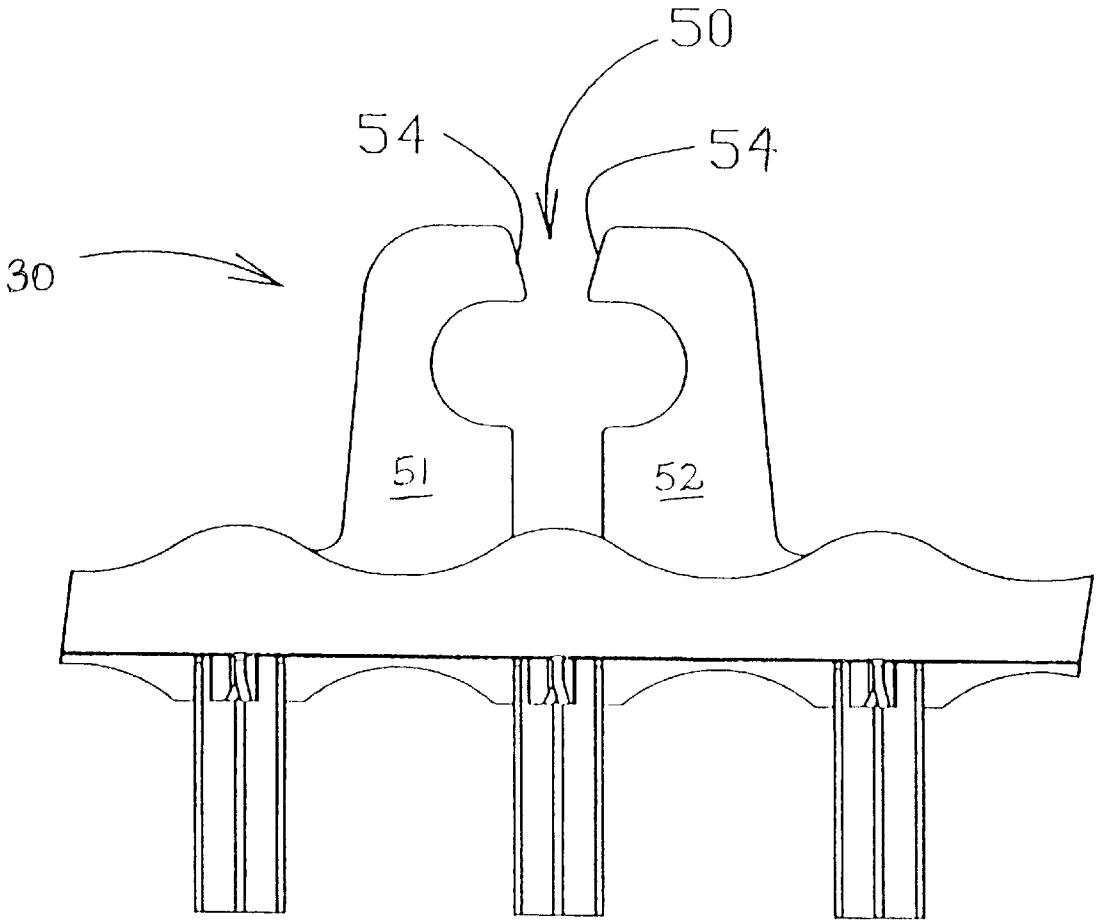
FIG. 5 is a part side view similar to that of FIG. 4 but illustrating a different handle arrangement.

An alternative form of handle 30 is shown in FIG. 5. This is similar to that described with respect to the embodiment shown in FIG. 1 but handle 30 is provided with a slot 50 which, in essence, splits the handle into two parts 51 and 52. When two such frames are stacked, a cell wall section 24 of the upper carton is able to pass through the slot 50 allowing the frame members 12 to lie and on another and the handles 30 to lie adjacent to each other. Slot 50 is provided with angled portions 54 which provide a wide mouth to facilitate sliding of wall section 24 therethrough whilst still retaining a new oval hand hole for convenience and comfort.

Figure 6:
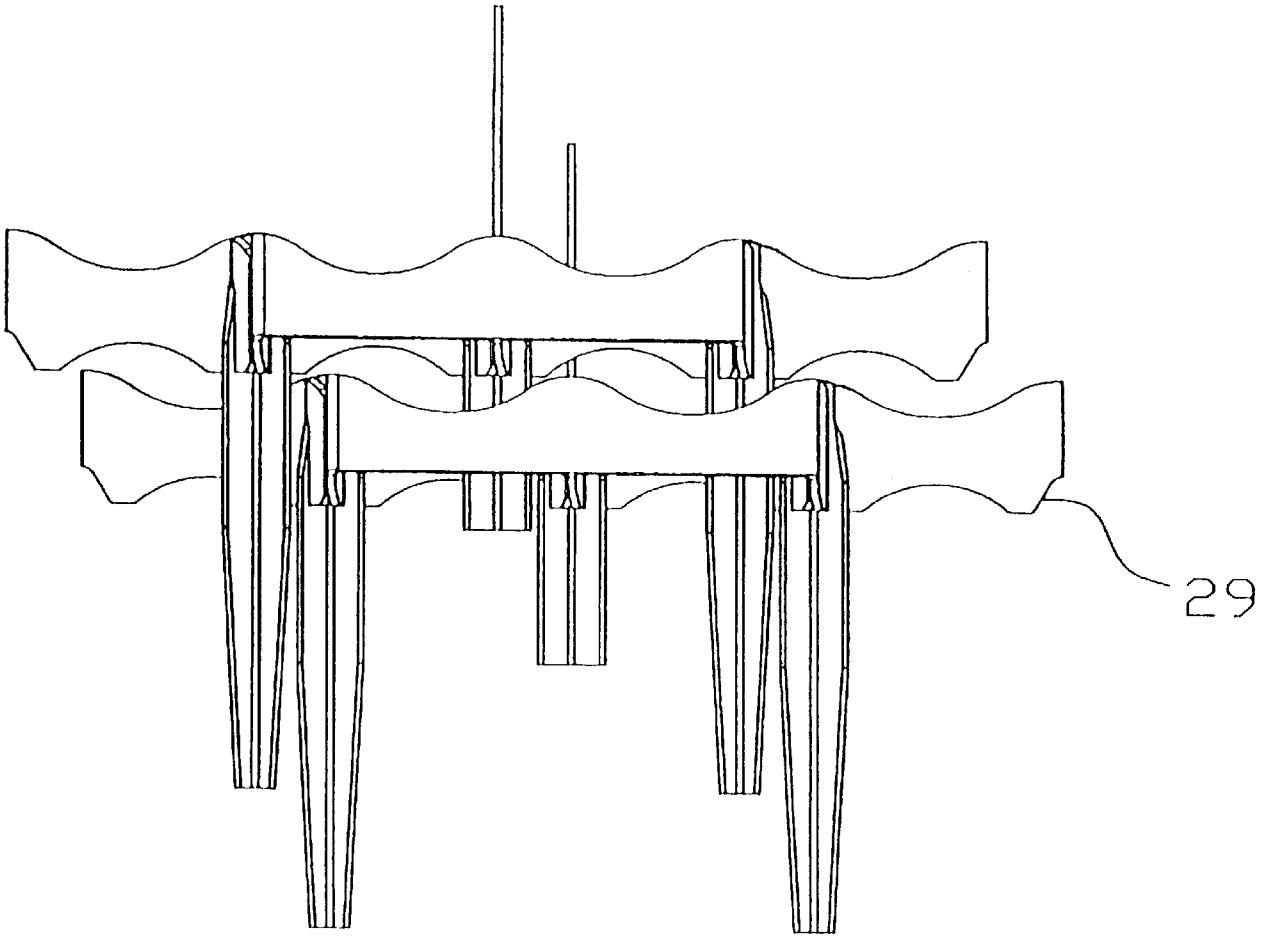
FIG. 6 is a side view of two similar bottle handling devices of the present invention in a nesting condition.
Figure 7:
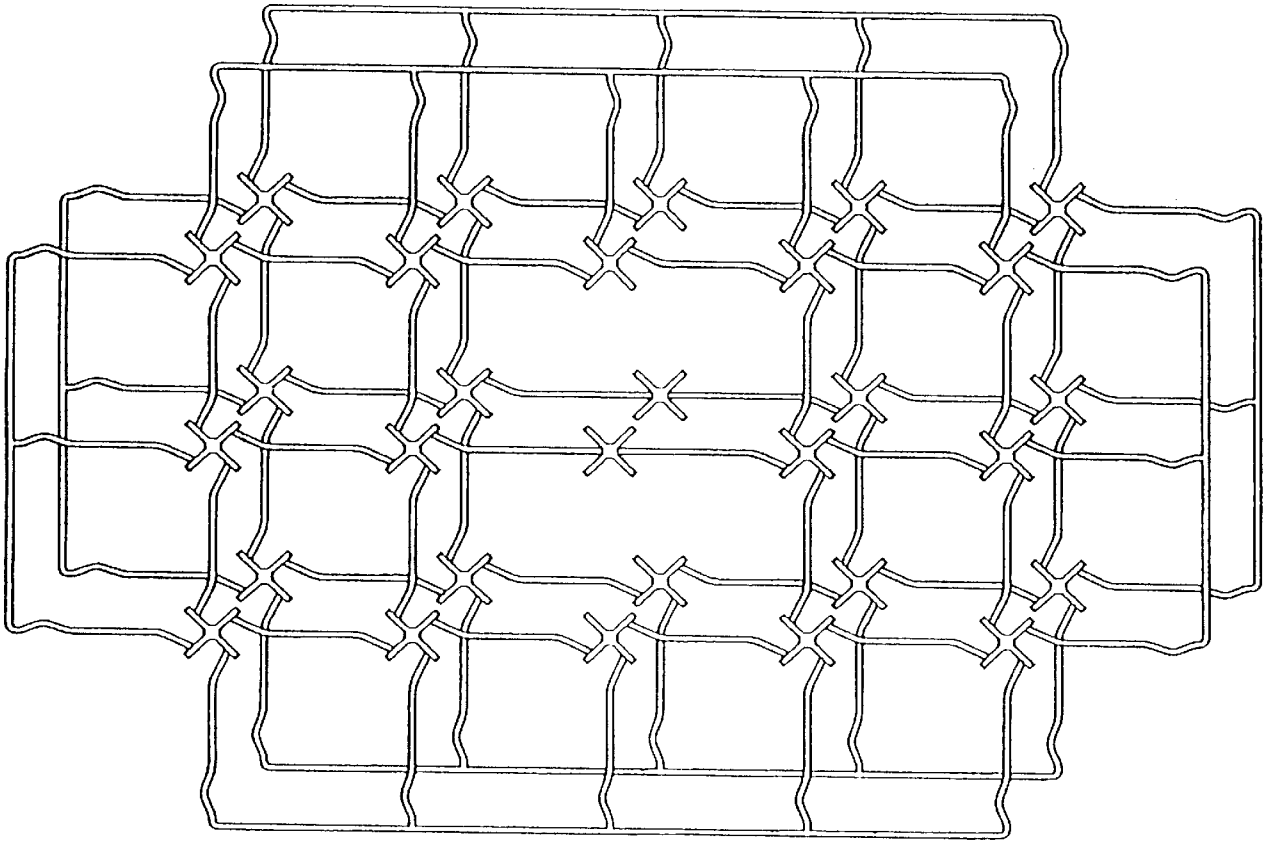
FIG. 7 is a plan view of the two nesting devices of FIG. 6 showing a modification to two cells through which a handle member, similar to that shown in the device of FIG. 4, can protrude during the resting condition.

Yet another alternative to provide for nesting or stacking of the devices is shown in FIGS. 6 and 7. In this embodiment, the device is the same as shown in FIG. 1 but a transverse cell wall 24 between two adjacent cells whose adjacent and parallel cell walls 24 constitute the base of the handle 30 has been eliminated. The handle 30 of a lower device is thereby able to pass through the resulting "double-cell" to provide stacking as shown in FIG. 6.

As indicated previously, the device of the present invention is used to advantage in connection with the 24 partitionless bottle carton, which is in wide use. However, other secondary containers such as a 6 bottle pack and a 12 bottle. FIG. 3*c* is a plan view of a device of the present invention for use in association with a 6-pack having a 2×3 configuration. In this case, it has one longitudinal wall member 20 and to transverse wall members 22, these members being joined via connections 26. In this embodiment, the extremities of the wall sections 24 are free and the six cells are defined by longitudinal and transverse wall sections 24, and a part of an end wall and a part of a sidewall of an associated carton. In FIG. 3*b* is shown a device of the present invention for use in a partitionless 12-pack having a 3 by 4 configuration. In this embodiment, the cells are defined by sections 24 of longitudinal and transverse frame wall members 20 and 24 apart from the four corner cells where two of the walls of each corner cell is and provided by parts of the end and sidewalks of an associated carton.

Figure 3A:
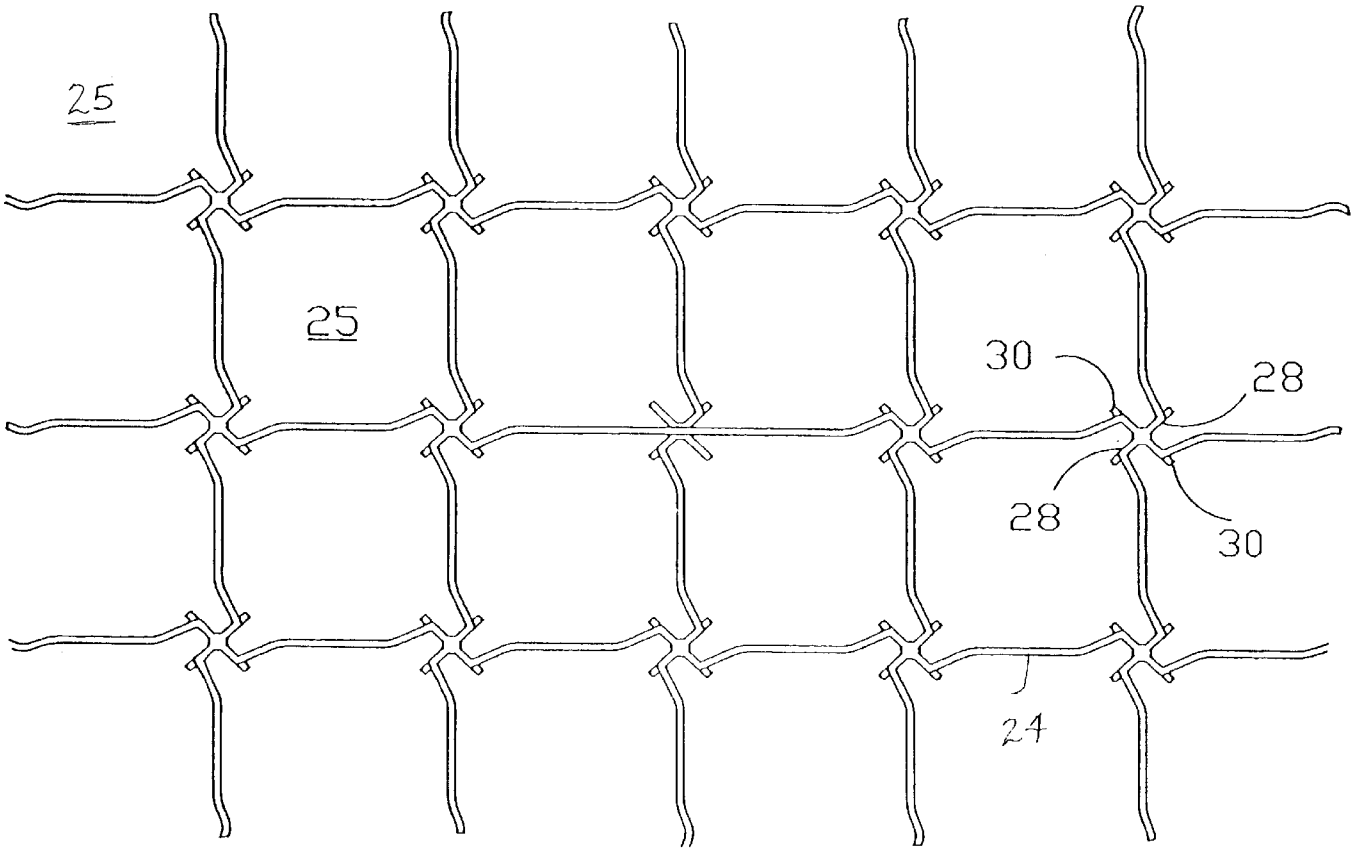
Figure 4:
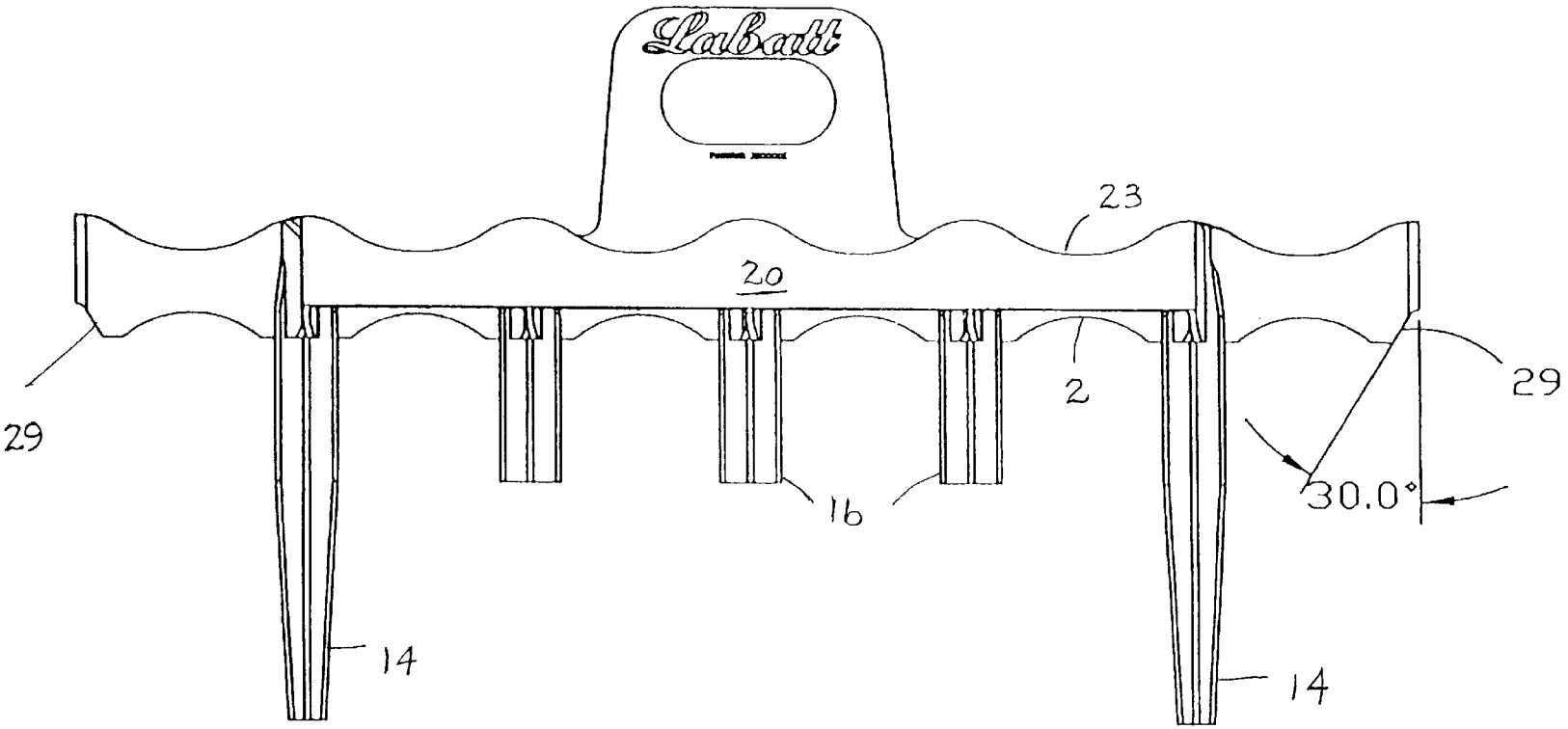
FIG. 4 is a side view in the direction of arrow A of the device of FIG. 1.

The embodiments shown in FIGS. 3*a*, 3*b* and 3*c* can be provided with the features described in detail elsewhere in this document with respect to the 24-pack embodiments; features such as a handle member; chamfered corners to assist insertion into the associated container; downwardly extending support members; and so on. It is felt that further details of such features here are unnecessary.

Figure 8:
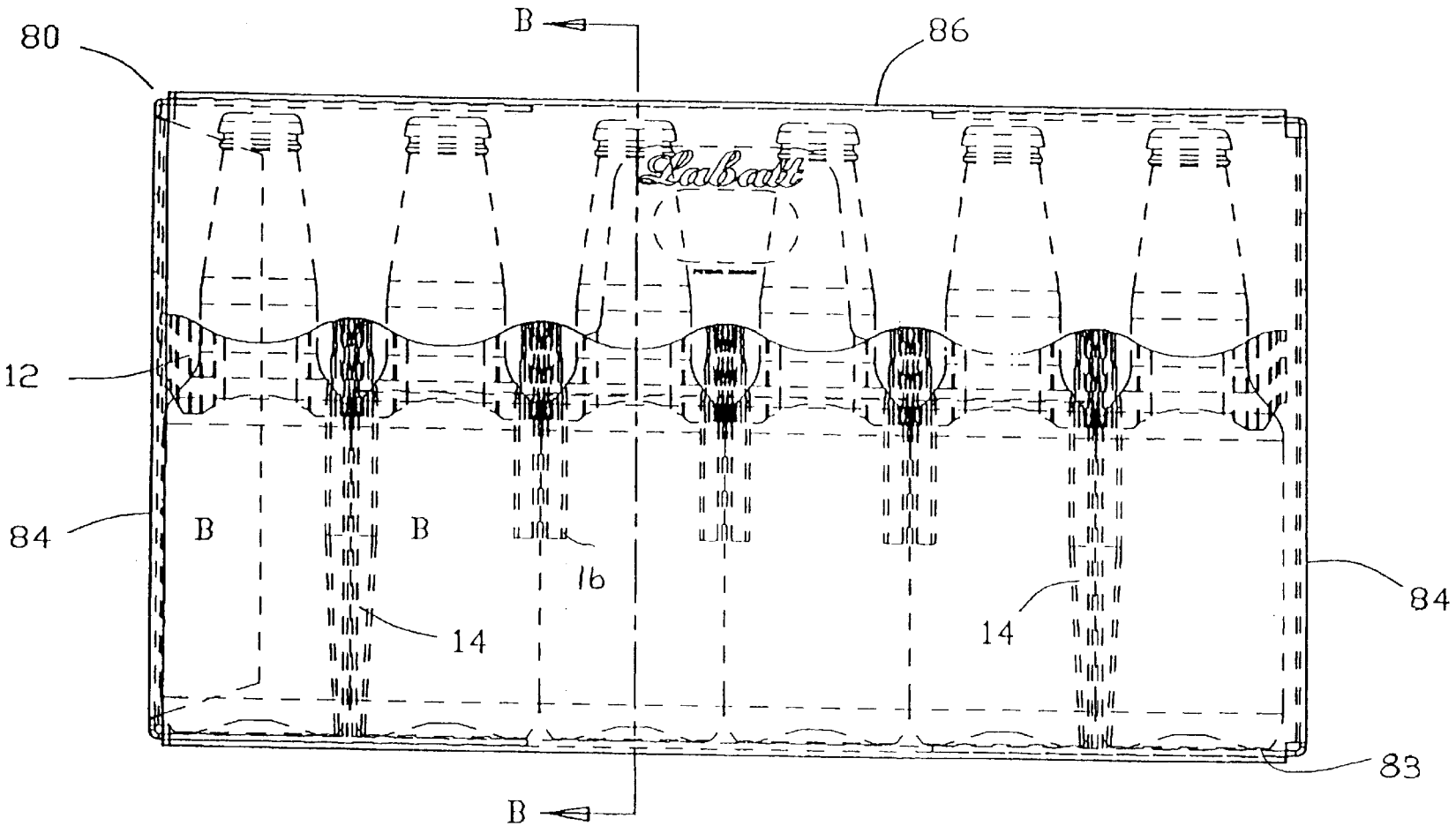
FIG. 8 is a side view of a sealed carton for twenty-four regular sized (341 ml) bottles of beer, the carton containing twenty-four beer-filled bottles and the bottle handling device shown in FIG. 1, both bottles and device being shown in phantom.

Turning to FIG. 8, this shows a carton generally designated 80, sidewall 82 (facing the reader), end walls 84 and top flaps 86. The device of the present invention as described with respect to FIG. 1 etc. lies inside the carton with frame 12, support legs 14 and bottle guides 16, as does six bottles all of which are shown in phantom. Note the handle height is such that it fits totally inside the sealed carton. This might be desired when a device of the present invention is being included in a carton of beer as a promotion or the like.

As can be seen, the frame 12 is located above the shoulders of the bottles 13 and in the spaces between the necks of the bottles 13 frame supports 14 and bottle guides 14 are located in the voids between adjacent bottles. Note that the bottle guides are of a length, which maintains the bottles in a vertical orientation when they rest on the carton base 83.

Figure 9:
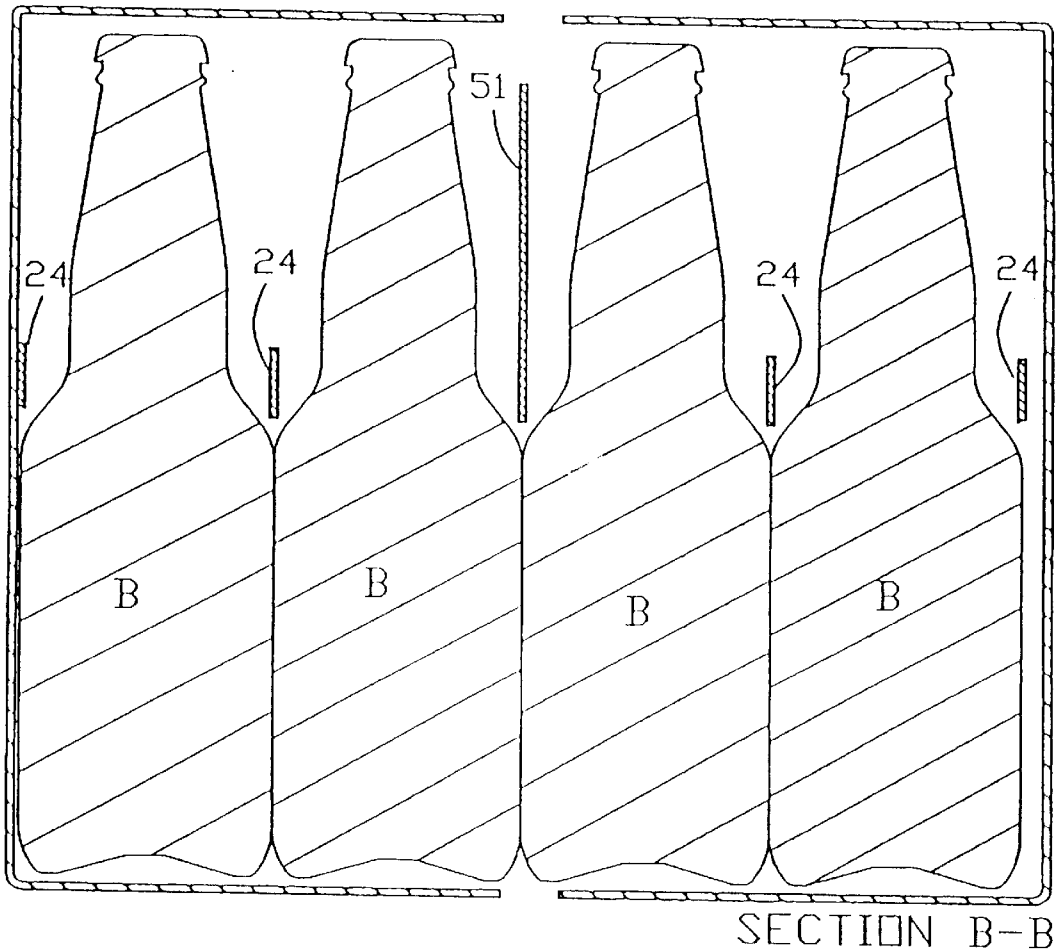
FIG. 9 is a section along the line B—B in FIG. 8.

In FIG. 9, a section along the line B—B in FIG. 8, four bottles B are shown resting on carton base 83 as well as handle 51 and cell wall sections 24. As can be seen, the cell wall sections 24 and handle 51 lie in voids or spaces above the volume occupied by the contacting main bodies of the bottles in the carton and between the necks of the bottles. Those frame members and the remainder of the frame of course, are maintained in position by support legs (not shown) which extend downwardly from the frame and are themselves, located in the vertical voids or spaces between the bottles as described above.

Figure 10:
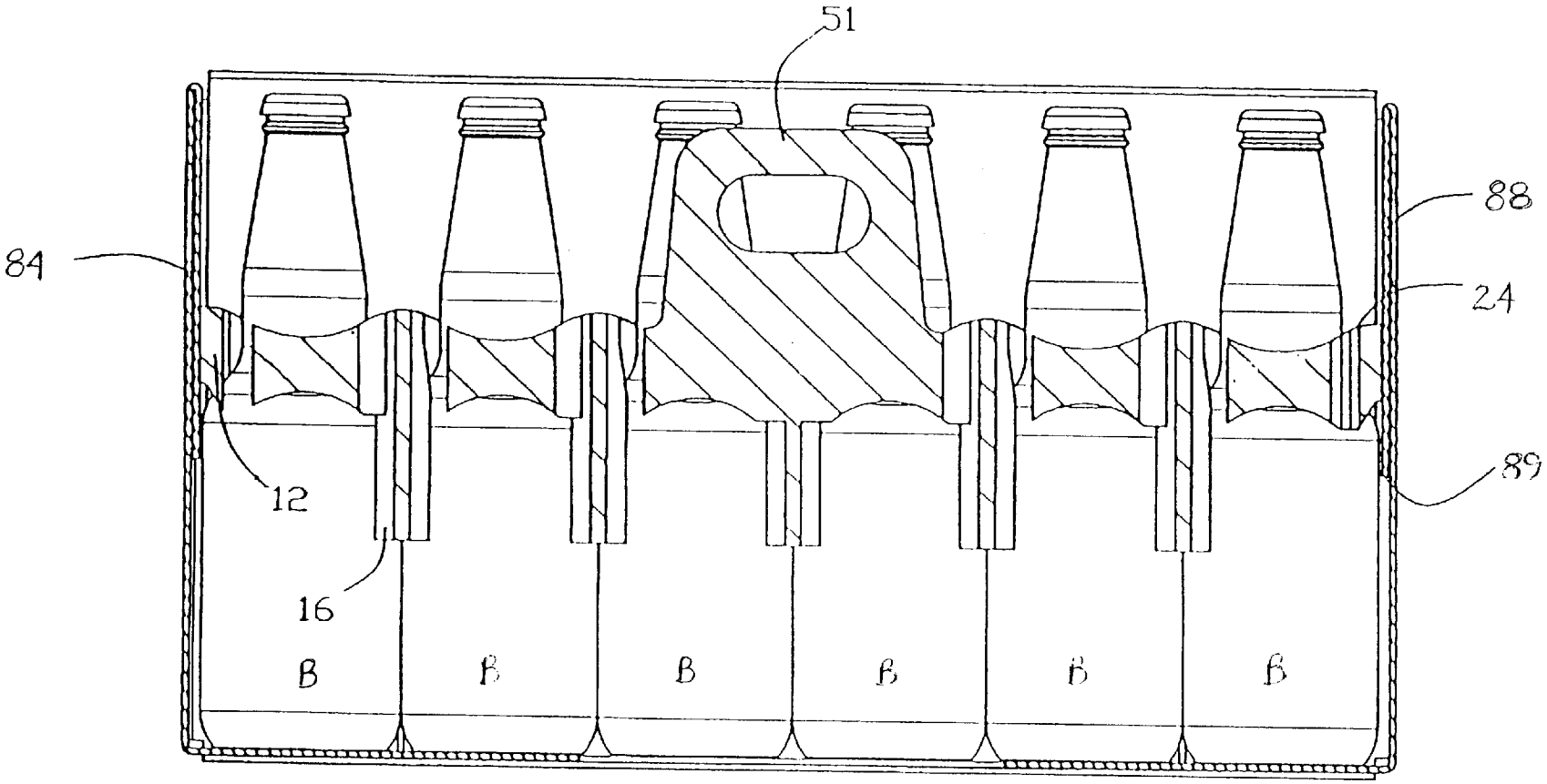
FIG. 10 is section through a filled twenty-four bottle beer carton containing the device shown in FIG. 1 along a plane which includes the handle member of the device, the carton being shown open with the flaps folded into the carton and lying adjacent a carton interior wall.

Turning to FIG. 10, this shows a section through a carton similar to that shown in FIGS. 8 and 9, but in which the end flaps 88 (as well as the not-shown side flaps) are folded into the carton and lie about half way down and against the interior of end walls 84. The device is maintained in position by legs (not shown) in the manner described with reference to FIGS. 8 and 9 and it should be noted that the frame is maintained at a level above the floor of the carton such that it lies in the space between the bottle necks and above that occupied by the in-contact main bodies of the bottles B. The upper edge 24 of the frame, and in this embodiment, all of the frame walls which abut the flap 88, lie above the edge 89 of flap 88. This ensures that the frame 12 when placed inside the carton cannot become lodged under edge 89 and hence, not be readily extracted when the carton has been filled. This becomes very important in the case where the end and/or top flaps are not wide and would not extend past the bottle shoulders when folded into the carton.

Figure 11:
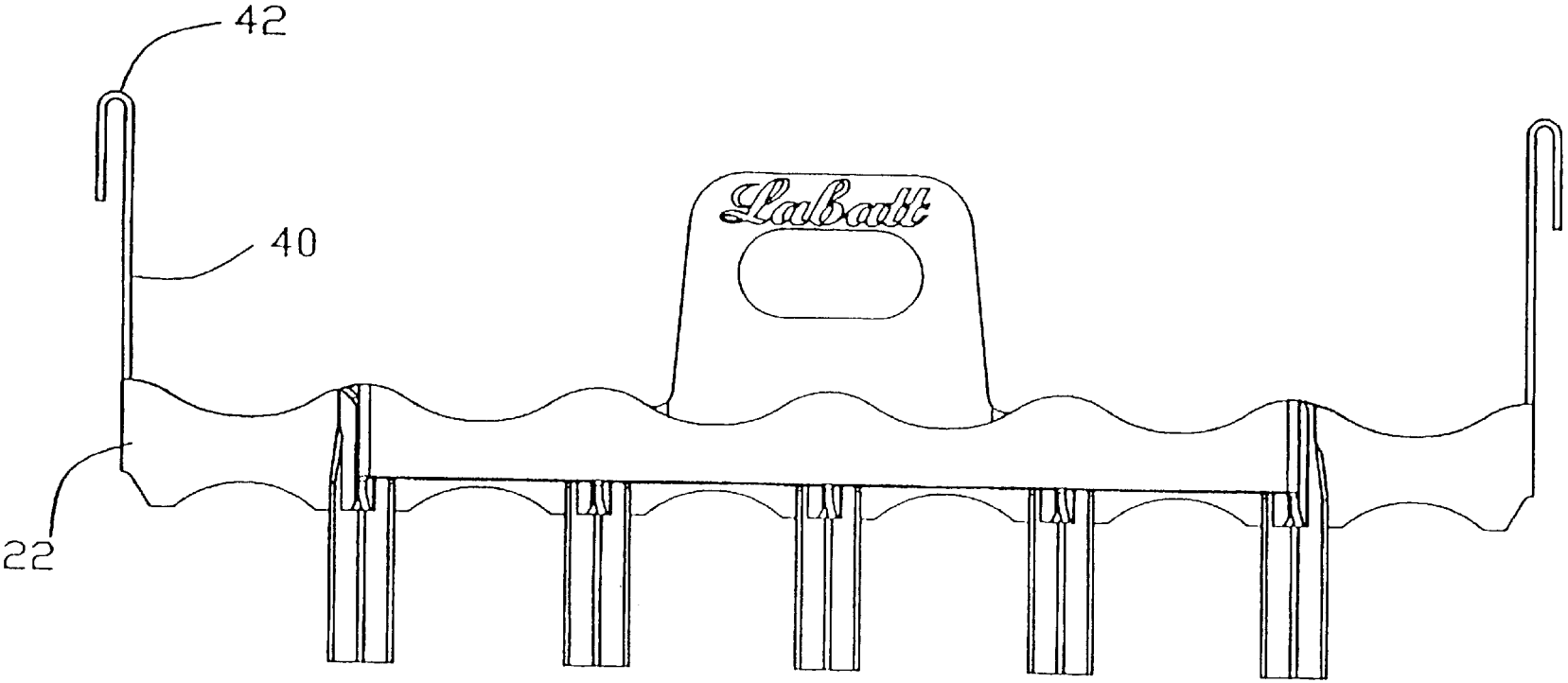
FIG. 11 illustrates an alternative support arrangement to maintain the device at the desired level in a container, the support comprising two or more upstanding arm members which abut the inside of the adjacent container wall or the folded-in flap.

Shown in FIG. 11 is an alternative form of frame support. This consists of support members or arms 40 which extend upwards from end frame members 22 and terminate in hook member 42. The latter is adapted to extend over the upper edge of a carton end wall—such as 84 shown in FIG. 10 and ensure that the arm 40 remains contacting or in case proximity to the interior of folded-in flap 88 to avoid blocking bottle entry into cells adjacent the carton wall.

The manner of use of the device is described above but to summarize an empty carton, say a 24-bottle carton with or without the top flaps—both side flaps and/or end flaps—folded into the carton is required to be filled with empty bottles. A device of the present invention, as shown in FIG. 1 and other FIGS. is inserted into the carton by holding the device via the handle, registering the rectangular frame with the open top of the carton and pushing the device into the carton until the supports or legs contact and rest on the interior of the carton base. The supports are, of course, of the same height and this result in the frame being maintained in a position generally parallel to the carton base. It will be appreciated that the frame is dimensioned to be a snug fit within the carton, that is, is not so tightly engaged by the carton walls that it cannot be relatively readily removed from the carton when the carton has been filled with its full complement of bottles. In any event, empty bottles are then loaded into the carton, one through each cell. A slight pressure sufficient to temporarily deform the cell walls may be required to urge the bottle through the cell which walls will then return to their original condition. The process is continued until all twenty-four bottles have been loaded into the carton. The device is then removed by grasping the handle and lifting vertically. Again, it should be noted that the only resistance to the withdrawal of the device involves the points of contact of the outer frame walls with the inner walls of the carton and the device 10 is dimensioned to ensure this is not excessive. The present invention has been described with reference to beverage, specifically beer, secondary containers. However, it will obviously be used in similar situations where it is necessary to load a plurality of primary containers into a secondary container for transport etc.

We claim:

1. A bottle handling device for inserting a predetermined number of similar bottles in an upright orientation into a rectangular container having a bottom, two sides and two end walls and which container is adapted to be fully filled by said number of bottles when in that orientation, the device comprising a generally rectangular frame adapted to be removably inserted into and nestle in said container which frame is constructed of a series of spaced mutually generally parallel longitudinal wall members and a series of spaced mutually generally parallel transverse wall members both series of members having ends which extend substantially to a container end wall or a container sidewall respectively when the device is located in said container, each member of each series being joined at a series of connections with members of the other series to form a plurality of similar sized cells each of which is bound on at least two sides by sections of said longitudinal and said transverse members each cell being adapted to allow passage therethrough of a main body of a bottle, said frame being adapted, when located in a container, to be maintained via support means parallel to a base of said container and in a volume in said container above a lower volume occupied by main bodies of bottles when located in said container, a bottle guide member extending at right angles from each connection which is shared by four cells and which is adapted to extend toward said container base, each said bottle guide member being dimensioned to fit within a void existing between four bottles when located in said cells, and wherein said support means comprises of bottle guide members extending from the connections of the intersections between longitudinal and transverse members.

2. A bottle handling device for inserting twenty-four similar bottles in an upright orientation into a container having a rectangular shaped bottom, two sides and two end walls and which container is adapted to be fully filled by said number of bottles when in that orientation, the device comprising a frame which is constructed of a series of spaced mutually generally parallel longitudinal wall members and a series of spaced mutually generally parallel transverse wall members both series of members having ends which extend substantially to a container end wall or a container sidewall respectively when the device is located in said container, each member of each series being joined at a series of connections with members of the other series to form a plurality of similar sized generally rectangular cells arranged in a rectangular array each cell of which is bound on at least two sides by sections of said longitudinal and said transverse members each cell being adapted to allow passage therethrough of a main body of a bottle, said frame being adapted to be removably insertable into and nestle in said container, and when located in a container, to be maintained, via support means extending out of a plane which includes said frame, parallel to a base of said container and in a volume in said container above a lower volume occupied by main bodies of bottles when bottles are located in said container, a bottle guide member extending at right angles from each connection which is shared by four cells and which guide member is adapted to extend toward said container base and is dimensioned to fit within a void existing between four adjacent bottles when same are located in said cells, and wherein said support means comprises of bottle guide members extending from the connections of the intersections between longitudinal and transverse members.

3. A bottle handling device for inserting six similar bottles in an upright orientation into a rectangular container having a bottom, two sides and two end walls and which container is adapted to be fully filled by said number of bottles when in that orientation, the device comprising a generally rectangular frame adapted to be removably inserted into and nestle in said container which frame is constructed of a longitudinal wall member and two spaced mutually generally parallel transverse wall members the longitudinal member and the two transverse members having ends which extend substantially to a container end wall or a container sidewall respectively when the device is located in said container, the longitudinal member being joined at one connection with each of the two transverse members to form six similar sized cells each of which is bound on at least two sides by sections of said longitudinal and said transverse members each cell being adapted to allow passage therethrough of a main body of a bottle, said frame being adapted, when located in a container, to be maintained via support means parallel to a base of said container and in a volume existing above a lower volume occupied by main bodies of bottles when located in said container, a bottle guide member extending at right angles from each of the two connections and adapted to extend toward said container base, each said bottle guide member being dimensioned to fit within a void existing between four adjacent bottles when same are located in said cells, and wherein said support means comprises of bottle guide members extending from the connections of the intersections between longitudinal and transverse members.

4. The device according to claim 1, 2 or 3 wherein said frame is maintained parallel to said base by said support means extending at right angles from said frame.

5. The device according to claim 1, 2, or 3 wherein said support means extends downwardly from said frame to said container base and is adapted to fit within said void.

6. The device according to claim 1, 2 or 3 wherein each corner cell is bordered on only two sides by sections of the longitudinal and transverse members.

7. The device according to claim 1 wherein there are five such longitudinal members and seven such transverse members, joined so as to form twenty-four, generally rectangular similar sized cells.

8. The device according to claim 7 wherein each outermost longitudinal member extends only from the second to the sixth transverse member and is secured to an end of each such transverse member and each outermost transverse member extends only from the second to the fourth longitudinal members and is secured to an end of each such longitudinal member.

9. The device according to claim 1, 2 or 3 wherein a number of said bottle guide members are extended so as to constitute said support means.

10. The device according to claim 7 or 8 wherein said support means comprise extensions of bottle guide members extending from the connections between said second and fourth longitudinal and second and fifth transverse members.

11. The device according to claim 1 wherein handle means are provided extending away from a side of the frame opposite to a side carrying the bottle guides.

12. The device according to claim 11 wherein the handle means is adapted to pass through a cell of a similar device nested thereon.

13. The device of claim 1, 2 or 3 which is made of a semi rigid plastics material.

14. The device according to claim 1, 2 or 3 which is made of polypropylene.

15. The device according to claim 11 which is injection molded in one piece.

16. The device according to claim 1, 2 or 3 wherein each connection has a cross-section in the form of an X, each limb of which is outside a plane which includes the sections which are joined to a limb at that same connection.

17. The device according to claim 1, 2 or 3 wherein each section of such longitudinal and transverse frame member which forms an individual cell wall is sinuous in form.

18. The device according to claim 1, 2 or 3 wherein an edge of each said section which forms part of a cell opening which is adapted to receive a bottle is scalloped.

19. The device according to claim 1, 2 or 3 wherein a part of the longitudinal and the transverse frame wall members on the side of the frame carrying the bottle guides and which are adjacent an end wall or a side wall of the container are chamfered.

20. The device as claimed in claim 3 wherein two further longitudinal members are located generally parallel to and one on each side of said longitudinal member and each is connected to an end of one transverse member and extends and is connected to an adjacent end of the other transverse member.

* * * * *